US006855218B1

(12) United States Patent
Kawalla et al.

(10) Patent No.: US 6,855,218 B1
(45) Date of Patent: Feb. 15, 2005

(54) METHOD FOR PRODUCING A HOT-ROLLED STRIP

(75) Inventors: Rudolf Kawalla, Bobritzsch (DE); Hans Pircher, Mülheim (DE); Thomas Heller, Duisburg (DE); Bernhard Engl, Dortmund (DE); Pino Tesè , Oberhausen (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 09/936,381

(22) PCT Filed: Feb. 24, 2000

(86) PCT No.: PCT/EP00/01517

§ 371 (c)(1),
(2), (4) Date: Dec. 21, 2001

(87) PCT Pub. No.: WO00/55381

PCT Pub. Date: Sep. 21, 2000

(51) Int. Cl.[7] ..... C21D 7/13

(52) U.S. Cl. ..... 148/654; 148/601; 148/602; 148/661; 148/541

(58) Field of Search ..... 148/601, 602, 148/654, 661, 541

(56) References Cited

FOREIGN PATENT DOCUMENTS

| | | | | |
|---|---|---|---|---|
| EP | 0072867 A | | 3/1983 | |
| EP | 0719868 A | | 7/1996 | |
| JP | 357002840 A | * | 1/1982 | ..... 148/602 |
| JP | 09241790 A | | 9/1997 | |
| JP | 10195588 A | | 7/1998 | |
| WO | WO 9739152 | | 10/1997 | |

* cited by examiner

*Primary Examiner*—Deborah Yee
(74) *Attorney, Agent, or Firm*—Proskauer Rose LLP

(57) ABSTRACT

The invention relates to a method for producing hot strip which features good forming ability and increased strength. This is achieved in that a hot strip (W) which is produced in particular from continuous casting in the shape of reheated slabs or slabs obtained directly from the casting heat, from thin slabs or cast strip, based on a steel comprising (in mass %) C: 0.001–1.05%; Si: ≦1.5%; Mn: 0.05–3.5%; Al: ≦2.5%, if necessary further elements such as Cu, Ni, Mo, N, Ti, Nb, V, Zn, B, P, Cr, Ca and/or S, with the remainder being iron as well as the usual accompanying elements, is continuously finish rolled and subsequently continuously cooled, with cooling taking place in at least two subsequent cooling phases ($t_{CK}$, $t_{LK}$) of accelerated cooling, to a final temperature; with the first cooling phase ($t_{CK}$) of accelerated cooling starting at the latest three seconds after the last pass of finish rolling; and with the hot strip (W) during the first cooling phase ($t_{CK}$) of accelerated cooling being cooled at a cooling rate of at least 150° C./s.

16 Claims, 2 Drawing Sheets

METHOD FOR PRODUCING A HOT-ROLLED STRIP

BACKGROUND OF THE INVENTION

The invention relates to a method for producing a hot strip steel in which following finish rolling, the hot strip is subjected to a cooling process carried out in several stages.

Cooling of a hot strip following finish rolling, which normally takes place in several passes, is very important as far as the characteristic properties of the materials of the strip are concerned. Among other things, the application of suitable cooling makes it possible to influence the microstructure itself, as well as the individual types of structure which make up this microstructure. It is thus possible for example, by way of the cooling process, to influence the strength, toughness and hardness of a hot strip.

The article "Hot rolled coils for special applications", A. De Vito et al., BTF—special issue 1986, pages 137–141, describes various studies which document the influence which cooling has on the production of hot strip. These studies show that it is for example advantageous in the production of a dual-phase hot strip steel (DP hot strip steel) to carry out the cooling process which follows finish rolling, in three stages. In the first and last of these three stages, the strip passes through conventional laminar cooling sections, arranged so as to be spaced apart from each other, whereby coolant is sprayed onto the strip in the form of a multitude of "veils", one arranged behind the other in the direction of conveyance of the strip. The cooling rate achieved in this process is approx. 70° C./s in the first cooling stage. Cooling of the strip in the third stage takes place more slowly than in the first stage.

In the intermediate stage which is passed between the laminar cooling sections, in the known method, cooling takes place by exposure to air, whereby again the cooling rate achieved in this stage is far below that of the last stage of the cooling process.

It has been shown that using the previously explained, known method, DP hot strip steels can be produced which do not contain molybdenum, with said DP steels comprising distinct martensite and ferrite constituents. The respective hot strip steels are of increased strength and toughness.

At the same time however, a decrease in ductility has to be accepted. Furthermore, it has become evident that the improvements which can be achieved with the known method are not sufficient to meet the requirements prescribed of hot strip produced in this way, in particular they do not meet hardness requirements.

SUMMARY OF THE INVENTION

It is thus the object of the invention to provide a method for producing hot strip of very considerable forming ability and increased strength.

According to the invention this object is met by a method for producing a hot strip which is produced in particular from continuous casting in the shape of reheated slabs or slabs obtained directly from the casting heat, from thin slabs or cast strip, based on a steel comprising (in mass %) 0.001–1.05% C, ≦1.5% Si, 0.05–3.5% Mn, ≦2.5% Al, if necessary further elements such as Cu, Ni, Mo, N, Ti, Nb, V, Zn, B, P, Cr, Ca and/or S, with the remainder being iron as well as the usual accompanying elements, involving the following steps:

continuous finish rolling of the hot strip;

continuous cooling of the hot strip, in at least two subsequent cooling phases of accelerated cooling, to a final temperature;

with the first cooling phase of accelerated cooling starting at the latest three seconds after the last pass of finish rolling; and with the hot strip during the first cooling phase of accelerated cooling being cooled at a cooling rate of at least 150° C./s.

According to the invention, cooling of the hot strip also takes place in at least two subsequently passed stages. In the first cooling phase the hot strip is cooled significantly faster than is the case with the state of the art. This compact cooling during the first cooling phase causes the $\gamma/\alpha$ transformation of the strip which was hot rolled in the $\gamma$ area, in an effective and targeted way, to be suppressed towards lower temperatures. The strip is then cooled to the desired final temperature in the subsequently passed second cooling phase of accelerated cooling. In this cooling phase the hardness-increasing secondary phases of the hot strip microstructure, such as martensite, bainite and residual austenite, cease. (The final temperature reached at the end of the second cooling phase of accelerated cooling, can of course be the coiling temperature required depending on the desired processing results).

Depending on the desired characteristic properties of the materials, the steel used in the production of the hot strip can optionally comprise additional elements. If such elements are present, the constituents (in mass %) of Cu, Ni, Mo should not exceed 0.8%, that of N, Ti, Nb, V, Zn, B should not exceed 0.5%, that of P should not exceed 0.09%, that of Cr should not exceed 1.5% and that of S should not exceed 0.02%.

Trials have shown that among others in particular such steels of the type mentioned above, which comprise 0.005 to 0.4 mass % silicon, are suitable for implementing the method according to the invention.

The method according to the invention is suitable for producing hot strip produced on the basis of steels with low carbon content. Thus an advantageous variant of the method according to the invention is characterised in that the steel (in mass %) comprises no more than 0.07% C, no more than 0.2% Si, no more than 0.6% Mn and no more than 0.08% Al; in that the hot strip during finish rolling is rolled in the austenitic area; in that the hot strip in the first cooling phase of accelerated cooling, starting at a temperature above 850° C., is cooled to a temperature of 680 to 750° C.; in that the hot strip in the second cooling phase of accelerated cooling is cooled to a temperature of less than 600° C. and is subsequently coiled.

The method according to the invention is also suitable for producing DP hot strip steels. A respective embodiment of the method according to the invention is characterised in that the steel (in mass %) comprises 0.04–0.09% C, no more than 0.2% Si, 0.5–2.0% Mn, 0.02–0.09% P and no more than 0.9% Cr, and in that the hot strip after finish rolling in the first cooling phase of accelerated cooling starting from a temperature above 800° C., is cooled to a temperature of 650 to 730° C.; in that the hot strip in the second cooling phase of accelerated cooling is cooled to less than 500° C.; and in that the hot strip is subsequently coiled.

In the case of steels with increased carbon constituents too, improvements in the characteristic properties of the materials can be achieved with the approach according to the invention. Thus according to a further embodiment of the invention a hot strip based on a steel with (in mass %) 0.25–1.05% C., no more than 0.25% Si and no more than 0.6% Mn, after finish rolling in the first cooling phase of accelerated cooling starting from a temperature above 800° C., is cooled to a temperature of between 530 and 620° C.; in the second cooling phase of accelerated cooling said steel is cooled to less than 500° C. and is subsequently coiled. A hot strip produced in this way also has improved hardness and better forming characteristics when compared to conventionally produced strip.

In the case of a TRIP hot strip containing aluminium which (in mass %) comprises 0.12–0.3% C, 1.2–3.5% Mn and 1.1–2.2% Al and in the manner according to the invention after finish rolling in the first cooling phase starting from a temperature between the $Ar_3$ temperature and a temperature of $Ar_3$+150° C., is cooled to a temperature which is up to 50° C. below the $Ar_3$ temperature; in the second cooling phase is cooled to 350 to 550° C. and is subsequently coiled, improvements in strength are also shown while the forming ability remains at the same high level.

A further advantageous variant of the method according to the invention is characterised in that the steel (in mass %) comprises 0.04–0.09% C, 0.5–1.5% Si, 0.5–2.0% Mn, 0.4–2.5% Al, no more than 0.09% P as well as no more than 0.9% Cr; in that the hot strip after finish rolling in the first cooling phase of accelerated cooling starting from a temperature above 800° C. is cooled to a temperature of 650 to 730° C.; in that the hot strip in the second cooling phase of accelerated cooling is cooled to less than 500° C. and that the hot strip is subsequently coiled. Such a hot strip has DP and TRIP characteristics.

A structural steel with an increased ferrite constituent and resulting particularly good formability, can be produced in that the steel (in mass %) comprises 0.07–0.22% C, 0.1–0.45% Si as well as 0.2–1.5% Mn; in that the hot strip after finish rolling in the first cooling phase of accelerated cooling starting from a temperature above 800° C. is cooled to a temperature of 650 to 730° C.; in that the hot strip in the second cooling phase of accelerated cooling is cooled to less than 500° C.; and in that the hot strip is subsequently coiled. With the same steel composition a hot strip with improved hardness compared to the above strip can be achieved in that the hot strip after finish rolling in the first cooling phase of accelerated cooling starting from a temperature above 800° C. is cooled to a temperature of 580 to 650° C.; in that the hot strip in the second cooling phase of accelerated cooling is cooled to less than 500° C.; and in that the hot strip is subsequently coiled. With a reduced ferrite constituent, the hot strip cooled in this way has increased bainite and martensite constituents.

According to an advantageous embodiment of the invention, between the first cooling phase and the second cooling phase of accelerated cooling, the hot strip passes through an intermediate cooling phase during which the hot strip is subjected to cooling by exposure to air. This intermediate cooling phase should last for at least one second. During the intermediate cooling phase which follows the first phase of compact (i.e. highly accelerated) cooling, in which intermediate cooling phase cooling as a result of exposure to air results, the austenite to ferrite transformation takes place faster and reaches a greater extent than is the case in the state of the art. At the same time a very substantial grain refining effect can be observed.

Surprisingly it has been found that the approach according to the invention makes it possible to produce a hot strip of increased hardness and of closer-grained microstructure, when compared to a hot strip of the same composition produced in the conventional method in two laminar cooling stages with interposed cooling as a result of exposure to air. At the same time, the strip produced according to the method according to the invention is of high strength and, unlike strips produced according to the known method, has good formability.

In order to safely suppress the $\gamma/\alpha$ transformation until lower temperatures have been reached, the phase of compact cooling should take place at the highest possible cooling rates and as far as possible immediately following the last pass of finish rolling. According to a preferred embodiment of the invention, the first cooling phase thus starts at the latest two seconds after the last pass of finish rolling, with the cooling rate in the first cooling phase being at least 250° C./s.

A further advantageous embodiment of the invention with which a hot strip of particularly good formability can be produced, is characterised in that at least one of the passes during finish rolling is carried out in the austenitic range below a temperature of $Ar_3$+80° C., and in that the overall pass reduction during finish rolling exceeds 30%.

Depending on the nature and composition of the steel used for producing the hot strip, it is advantageous if the steel, which in particular is fed to the respective mill train in the shape of thin-slab raw material, in the liquid phase has been treated with Ca or Ca carrier alloys.

Depending on the respective desired work result, it can finally be advantageous if the hot strip in the second cooling phase is cooled at a cooling rate of at least 30° C./s.

BRIEF DESCRIPTION OF THE DRAWINGS

Below, the invention is explained in more detail with reference to a drawing which shows one embodiment. The following are diagrammatically shown.

DETAILED DESCRIPTION OF THE INVENTION

Figure 1:
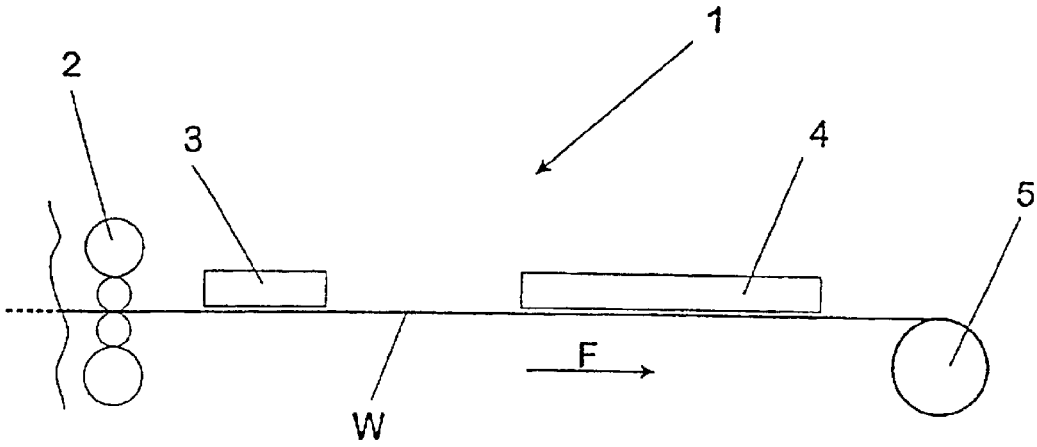
FIG. 1 a lateral view of the end section comprising a cooling section, of a line for producing hot strip.
Figure 2:
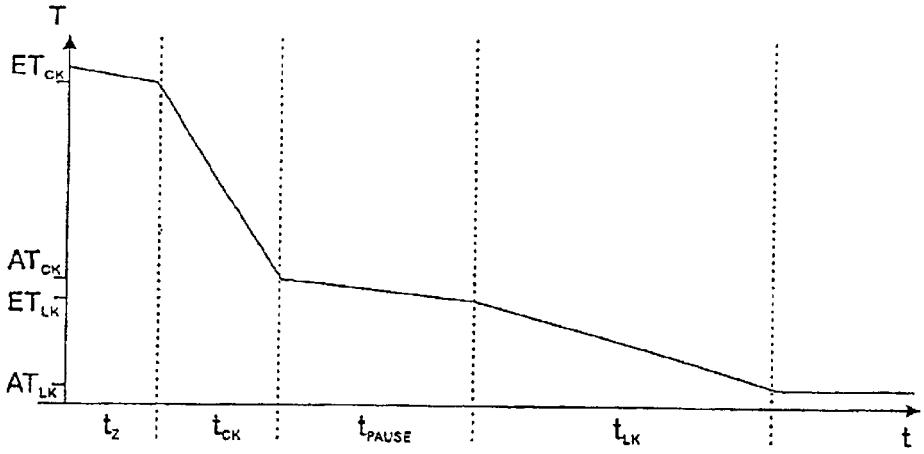
FIG. 2 a diagram showing the temperature gradient during cooling within the cooling section.

The line 1 for producing a hot strip W comprises a group of stands incorporating several finishing stands of which only the last stand 2 is shown in the diagram. In the finishing roll line, the hot strip W is rolled to its desired final thickness.

A short distance behind the last finishing stand 2, a compact cooling device 3 is arranged. This compact cooling device 3 comprises nozzles (not shown) which convey coolant, preferably water, at pressure onto the top and bottom of the hot strip W. The volume flow of the coolant can be adjusted such that within the compact cooling device 3, cooling rates of 150° C./s to 1000° C./s can be achieved.

In the direction of conveyance F of the hot strip W, at a distance to the compact cooling device 3, a second cooling device 4 is arranged. The second cooling device 4 operates in the manner of a conventional laminar cooling device, with the coolant being applied in a fan-shape to the hot strip W by means of several nozzles (not shown) arranged one behind the other, in the direction of conveyance F. The number of the nozzles in operation and/or the volume flow of the coolant delivered in the region of the laminar cooling device 4 can be regulated such that in the region of the laminar cooling device 4 cooling rates of 30 to 150° C./s can be achieved.

A coiling device 5 in which the hot strip W is coiled is arranged behind the laminar cooling device 4 in the direction of conveyance F of the strip.

A hot strip W, for example produced from a multiphase steel is rolled in the finishing roll line exclusively in the austenitic area at an overall pass reduction exceeding 30%. If necessary, the hot strip W is subjected to thermo-mechanical treatment during rolling.

After the hot strip W has left the last stand 2 of the finishing roll line, within a transfer phase $t_Z$ lasting less than two seconds, said strip moves to the compact cooling device 3. As the hot strip W enters the compact cooling device 3, in a first cooling phase $t_{CK}$ it is continually subjected to a compact cooling process during which the hot strip W is cooled from an entry temperature $ET_{CK}$ to an exit temperature $AT_{CK}$. The cooling rates achieved during this process range between 250 and 1000° C./s. As a result of the increased cooling of the hot strip W in the compact cooling device 3 taking place within a short time $t_Z$ after exiting from the finishing roll line, the $\gamma/\alpha$ transformation of the hot strip steel is suppressed.

Subsequently, the hot strip W passes through a free section in which in an intermediate cooling phase $t_{PAUSE}$ it is cooled by exposure to air. The cooling phase $t_{PAUSE}$ lasts for at least one second. During this time, partial transformation of the hot strip steel takes place.

Subsequently the hot strip W reaches the laminar cooling device 4 where in a second cooling phase $t_{LK}$ it is cooled from an entry temperature $ET_{LK}$ to an exit temperature $AT_{LK}$. The cooling rate set for this ranges between 30 and 150° C./s. Depending on the respective chemical composition of the steel and the selected cooling rate, secondary phases (bainite, martensite or residual austenite) are formed which have an influence on the characteristic properties of the hot strip W. The precipitation condition of the hot strip W, too, is controlled in this way.

Finally, the hot strip W cooled in this way is coiled in the coiling device 5.

Table 1 shows a comparison of the microstructure constituents and the hardness between hot strip produced from steels "Steel 1"–"Steel 2" produced according to the method according to the invention, as explained above; and hot strip of the same composition produced in the conventional way in two laminar cooling devices with interposed cooling as a result of exposure to air.

TABLE 1

| | | INVENTION 1st cooling phase: compact cooling, cooling rate >250° C./s 2nd cooling phase: cooling by exposure to air 3rd cooling phase: Laminar cooling, cooling rate 30–150° C./s | | STATE OF THE ART 1st cooling phase: laminar cooling, cooling rate 30–150° C./s 2nd cooling phase: cooling by exposure to air 3rd cooling phase: Laminar cooling, cooling rate 30–150° C./s | |
|---|---|---|---|---|---|
| Steel | Type of structure | Content in % | Hardness HV10 | Content in % | Hardness HV10 |
| Steel 1 | Ferrite | 10 | 292 | Traces | 256 |
| | Pearlite | — | | — | |
| | Bainite | 40 | | 60 | |
| | Martensite | 50 | | 40 | |
| Steel 2 | Ferrite | 25 | 259 | ≦5 | 236 |
| | Pearlite | — | | — | |
| | Bainite | 25 | | 95 | |
| | Martensite | 50 | | — | |

Table 2 shows the compositions of the steels "Steel 1" and "Steel 2"

TABLE 2

| | C | Mn | P | S | Si | Cu | Al | N | Cr | Ni | Ti | Nb |
|---|---|---|---|---|---|---|---|---|---|---|---|---|
| Steel 1 | 0.15 | 1.38 | 0.009 | 0.007 | 0.42 | 0.01 | 0.026 | 0.0041 | 0.02 | 0.02 | 0.02 | 0.018 |
| Steel 2 | 0.13 | 1.45 | 0.012 | 0.004 | 0.35 | 0.14 | 0.037 | 0.0064 | 0.04 | 0.16 | | 0.034 |

Figure 3:
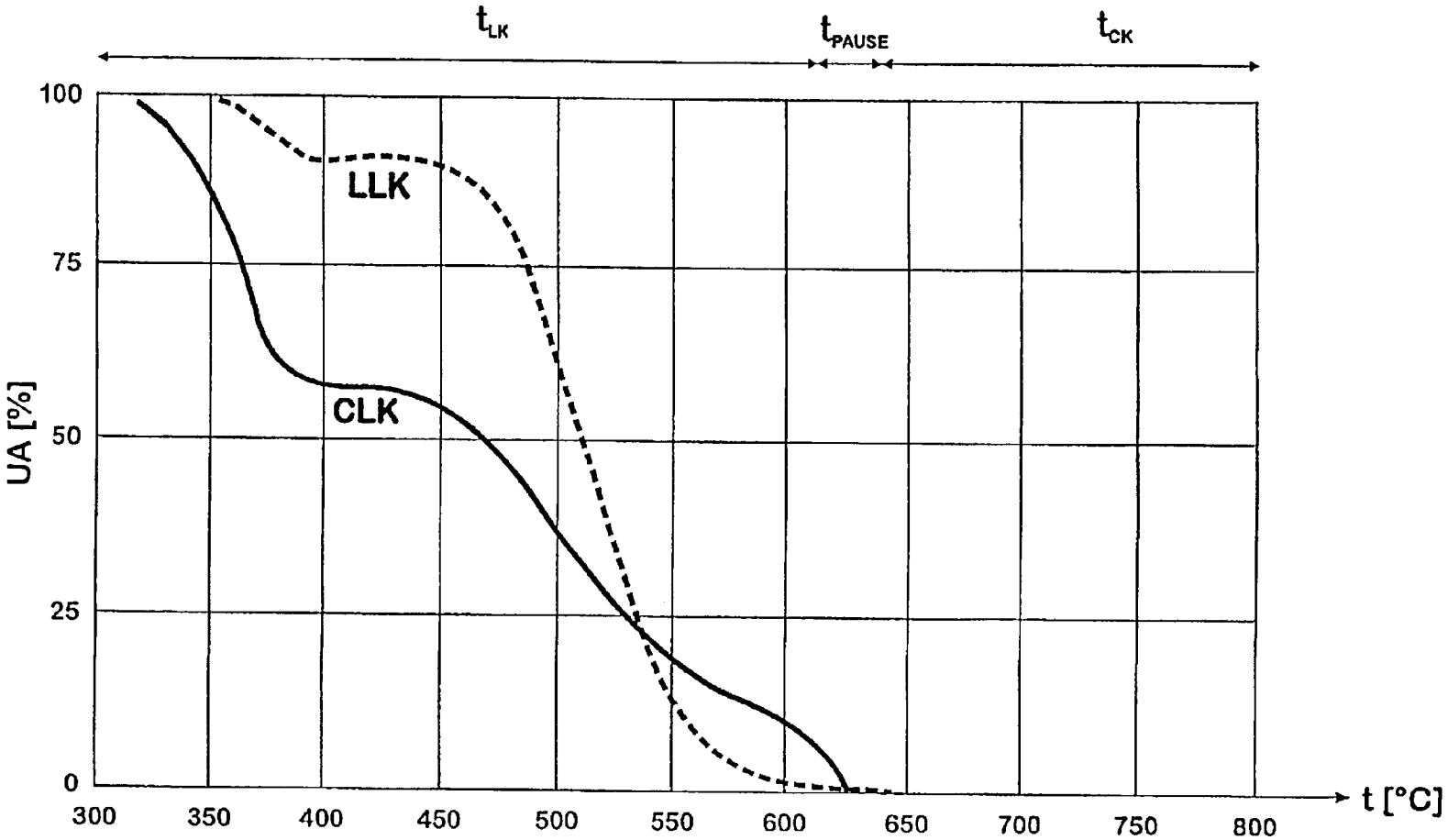
FIG. 3 a diagram showing the transformed constituents of a steel used in the production of a hot strip, with temperatures of the conventional processing method and temperatures of the processing method according to the invention being shown.

In relation to Steel 1, the solid line in FIG. 3 shows the gradient CLK of the microstructural transformation which occurs if a hot strip, according to the invention, first for a period $t_{CK}$ passes through a compact cooling process at a cooling rate of 250° C./s, followed by an intermediate cooling phase $t_{PAUSE}$ and then followed by a laminar cooling process lasting for a period $t_{LK}$. By way of comparison, the dashed line shows the gradient LLK of the microstructural transformation which occurs with a conventional combination of two laminar cooling processes with interposed cooling by exposure to air.

The above shows clearly that as a result of the superposed compact cooling process, the constituent of hard phases, i.e. phases which transform at low temperatures, increases. Thus, in the sequence according to the invention, of compact cooling/air cooling/laminar cooling, the transformed constituent UA of the austenite at a temperature of 450° C. only amounts to approx. 60%. Transformation of the remaining constituents of the austenite occurs to a larger extent at temperatures below 400° C., being completed only at a temperature of 320° C. By contrast, the transformed constituent UA in the case of the conventional laminar cooling/air cooling laminar cooling at 400° C. has already reached almost 90%, with transformation of the still remaining austenite already being completed at 350° C.

Table 1 confirms the statement of FIG. 3. With each of the hot strips examined, the application of the method according to the invention has achieved a shift in the microstructure constituents in favour of the harder martensitic phases, when compared to conventionally cooled strip. With identical composition, this results in a clear increase in the hardness of the respective hot strip.

At the same time the structure of the specimens produced according to the invention reveals a closer grain than that of the specimens produced according to the conventional method. Consequently, despite the increased amounts of hard phases, the formability of hot strip produced according to the invention is good. This was also confirmed in the case of a TRIP steel comprising ((in mass %) C: 0.2%, Al: 1.8% Mn: 1.6%). When produced in the conventional way, the median ferrite grain diameter of such a steel was 6–7 $\mu$m. In the process according to the invention, this diameter is reduced to less than 3 $\mu$m.

LIST OF REFERENCE SYMBOLS

| | |
|---|---|
| F | Direction of conveyance; |
| W | Hot strip; |
| 1 | Line for producing a hot strip; |
| 2 | Finishing stand; |
| 3 | Compact cooling device; |
| 4 | Laminar cooling device; |
| 5 | Coiling device; |
| $t_Z$ | Transfer phase between the exit from the finishing stand 2 and commencement of compact cooling; |
| $t_{CK}$ | First cooling phase, time required by the hot strip W to travel the length of the compact cooling device 3; |
| $ET_{CK}$ | Entry temperature of the hot strip W when entering the compact cooling device 3; |
| $AT_{CK}$ | Exit temperature of the hot strip W when leaving the compact cooling device 3; |
| $t_{PAUSE}$ | Intermediate cooling phase during which the hot strip W is cooled by exposure to air; |
| $t_{LK}$ | Second cooling phase in which the hot strip W is cooled in the laminar cooling device 4; |
| $ET_{LK}$ | Entry temperature of the hot strip W during entry to the laminar cooling device 4; |
| $AT_{LK}$ | Exit temperature of the hot strip W when leaving the laminar cooling device 4; |
| CLK | Gradient of the microstructural transformation which occurs when a hot strip first passes through compact cooling, followed by laminar cooling; |
| LLK | Gradient $L_{LK}$ of the microstructural transformation which occurs when two laminar cooling processes are combined; and |
| UA | Respective transformed austenite constituent. |

What is claimed is:

1. A method for producing a hot strip (W) which strip is produced in particular from continuous casting in the shape of reheated slabs or slabs obtained directly from the casting heat, from thin slabs or cast strip, based on a steel comprising (in mass %)

| | |
|---|---|
| C: | 0.001–1.05%; |
| Si: | ≦1.5%; |
| Mn: | 0.05–3.5%; |
| Al: | ≦2.5%; |

as well as optionally one or several of the following constituents

Cu, Ni, Mo with an amount of ≦0.8%;

N, Ti, Nb, V, Zn, B with an amount of ≦0.5%;

P with an amount of ≦0.09%;

Cr with an amount of ≦1.5%; and/or

S with an amount of ≦0.02%; and the remainder being iron as well as the usual accompanying elements, with the steel also optionally having been treated in the liquid phase with Ca or Ca carrier alloys, involving the following steps:

continuous finish rolling of the hot strip (W);

continuous cooling of the hot strip (W) in at least two subsequent cooling phases ($t_{CK}$, $t_{LK}$) of accelerated cooling, to a final temperature;

with the first cooling phase of ($t_{CK}$) of accelerated cooling starting at the latest three seconds after the last pass of finish rolling; and with the hot strip (W) during the first cooling phase ($t_{CK}$) of accelerated cooling rate of at least 250° C./s.

2. A method according to claim 1, characterized in that the steel comprises 0.005 to 0.4 mass % of silicon.

3. A method according to claim 1, characterized in that the steel comprises (in mass %)

| | |
|---|---|
| C: | ≦0.07%; |
| Si: | ≦0.2%; |
| Mn: | ≦0.6%; |
| Al: | ≦0.08%; |

in that the hot strip (W) during finish rolling is rolled in the austenitic area;

in that the hot strip (W) in the first cooling phase ($t_{CK}$) of accelerated cooling starting at a temperature above 850° C. is cooled to a temperature of 680 to 750° C.;

in that the hot strip (W) in the second cooling phase ($t_{LK}$) of accelerated cooling is cooled to a temperature of less than 600° C.; and in that the hot strip (W) is subsequently coiled.

4. A method according to claim 1, characterized in that the steel (in mass %) comprises

| | |
|---|---|
| C: | 0.04–0.09%; |
| Si: | ≦0.2%; |
| Mn: | 0.5–2.0%; |
| P: | 0.02–0.09%; |
| Cr: | ≦0.9%; |

in that the hot strip (W) after finish rolling in the first cooling phase ($t_{CK}$) of accelerated cooling starting from a temperature of about 800° C., is cooled to a temperature of 650 to 730° C.;

in that in the second cooling phase ($t_{LK}$) of accelerated cooling, the hot strip (W) is cooled to less than 500° C.; and in that the hot strip (W) is subsequently coiled.

5. A method according to claim 1, characterized in that the steel comprises (in mass %)

| | |
|---|---|
| C: | 0.25–1.05%; |
| Si: | ≦0.25%; |
| Mn: | ≦0.6%; |

in that the hot strip (W) after finish rolling in the first cooling phase ($t_{CK}$) of accelerated cooling starting from a temperature of about 800° C., is cooled to a temperature of between 530 and 620° C.;

in that the hot strip (W) in the second cooling phase ($t_{LK}$) of accelerated cooling is cooled to less than 500° C.; and in that the hot strip (W) is subsequently coiled.

6. A method according to claim 1, characterized in that the steel comprises (in mass %)

| | |
|---|---|
| C: | 0.12–0.3%; |
| Mn: | 1.2 ≦ 3.5%; |
| Al: | 1.1 ≦ 2.2%; |

in that the hot strip (W) after finish rolling in the first cooling phase ($t_{CK}$) of accelerated cooling starting from a temperature between the $Ar_3$ temperature and a temperature of $Ar_3$+150° C., is cooled to a temperature which is up to 50° C. below the $Ar_3$ temperature;

in that the hot strip (W) in the second cooling phase ($t_{LK}$) of accelerated cooling is cooled to 350 to 550° C.; and in that the hot strip (W) is subsequently coiled.

7. A method according to claim 1, characterized in that the steel comprises (in mass %)

| | |
|---|---|
| C: | 0.04–0.09%; |
| Si: | 0.5–1.5%; |
| Mn: | 0.5–2.0%; |
| Al: | 0.4–2.5%; |
| P: | ≦0.09%; |
| Cr: | ≦0.9%; |

in that the hot strip (W) after finish rolling in the first cooling phase ($t_{CK}$) of accelerated cooling starting from a temperature above 800° C., is cooled to a temperature of between 650 and 730° C.;

in that the hot strip (W) in the second cooling phase ($t_{LK}$) of accelerated cooling is cooled to a temperature of less than 500° C.; and in that the hot strip (W) is subsequently coiled.

8. A method according to claim 1, characterized in that the steel comprises (in mass %)

| | |
|---|---|
| C: | 0.07%–0.22%; |
| Si: | 0.1–0.45% |
| Mn: | 0.2%–1.5%; |

in that the hot strip (W) after finish rolling in the first cooling phase ($t_{CK}$) of accelerated cooling starting from a temperature above 800° C., is cooled to a temperature of between 650 and 730° C.;

in that the hot strip (W) in the second cooling phase ($t_{LK}$) of accelerated cooling is cooled to a temperature of less than 500° C.; and in that the hot strip (W) is subsequently coiled.

9. A method according to claim 1, characterized in that the steel comprises (in mass %)

| | |
|---|---|
| C: | 0.07%–0.22%; |
| Si: | 0.1–0.45% |
| Mn: | 0.2%–1.5%; |

in that the hot strip (W) after finish rolling in the first cooling phase ($t_{CK}$) of accelerated cooling starting from a temperature above 800° C., is cooled to a temperature of between 580 and 650° C.;

in that the hot strip (W) in the second cooling phase ($t_{LK}$) of accelerated cooling is cooled to a temperature of less than 500° C.; and in that the hot strip (W) is subsequently coiled.

10. A method according to claim 1, characterized in that between the first cooling phase ($t_{CK}$) of accelerated cooling and the second cooling phase ($t_{LK}$) of accelerated cooling the hot strip (W) passes through an intermediate cooling phase ($t_{PAUSE}$) during which the hot strip (W) is subjected to cooling by exposure to air.

11. A method according to claim 10, characterized in that the intermediate cooling phase ($t_{PAUSE}$) lasts for at least one second.

12. A method according to claim 1, characterized in that the first cooling phase ($t_{CK}$) of accelerated cooling starts at the latest two seconds after the last pass of finish rolling.

13. A method according to claim 1, characterized in that at least one of the passes during finish rolling is carried out in the austenitic range below a temperature of $Ar_3$+80° C., and in that an overall pass reduction during finish rolling exceeding 30% is achieved.

14. A method according to claim 1, characterized in that in the second cooling phase ($t_{LK}$) of accelerated cooling the hot strip (W) is cooled at a cooling rate of at least 30° C./s.

15. A method according to claim 1, characterized in that in the second cooling phase ($t_{LK}$) of accelerated cooling, the hot strip (W) is cooled at a cooling rate of 30° C./s to 150° C./s.

16. A method according to claim 1, characterized in that the cooling rate in the second cooling phase ($t_{LK}$) is less than the cooling rate in the first cooling phase ($t_{LK}$).

* * * * *